United States Patent [19]

Hoene

[11] 4,099,084

[45] Jul. 4, 1978

[54] IMPULSE DISCHARGE LAMP WITH DISC SHAPED ELECTRODES

[75] Inventor: Ernst Ludwig Hoene, Singapore, Singapore

[73] Assignee: Heimann GmbH, Germany

[21] Appl. No.: 754,368

[22] Filed: Dec. 27, 1976

[30] Foreign Application Priority Data

Jan. 22, 1976 [DE] Fed. Rep. of Germany ..... 2602309

[51] Int. Cl.[2] ..... H01J 61/06; H01J 61/30; H01J 61/36

[52] U.S. Cl. ..... 313/217; 313/220; 313/246

[58] Field of Search ..... 313/220, 217, 246, 318

[56] References Cited

U.S. PATENT DOCUMENTS

| | | | |
|---|---|---|---|
| 2,267,318 | 12/1941 | Aicher | 313/217 |
| 2,365,610 | 12/1944 | White | 313/246 X |
| 2,433,218 | 12/1947 | Herzog | 313/246 X |
| 3,488,547 | 1/1970 | Beintema et al. | 313/217 X |
| 3,693,007 | 9/1972 | Kerekes | 313/318 |
| 3,930,176 | 2/1974 | Panico | 313/318 X |

*Primary Examiner*—Palmer C. Demeo

*Attorney, Agent, or Firm*—Hill, Gross, Simpson, Van Santen, Steadman, Chiara & Simpson

[57] ABSTRACT

An impulse discharge lamp comprising a gas-filled hollow-cylindrical discharge receptacle, whose ends are sealed, vacuum tight, by respective electrodes, which are of disc- or cup-shaped configuration, and have an external diameter which is slightly less than the initial internal diameter of the discharge receptacle, with the electrodes having their peripheral edges rigidly secured, at the outer ends of the discharge receptacle to the internal surfaces thereof, and method of making the same.

4 Claims, 1 Drawing Figure

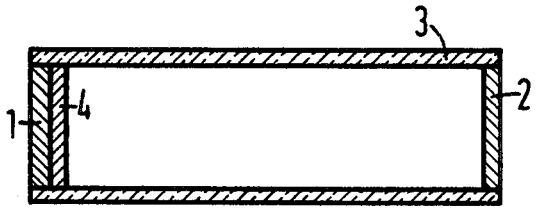
3
1
4
2

IMPULSE DISCHARGE LAMP WITH DISC SHAPED ELECTRODES

BACKGROUND OF THE INVENTION

The invention relates to an impulse discharge lamp having a hollow gas-filled cylindrical discharge receptacle, preferably filled with an inert gas, which receptacle is provided at each of its respective ends with an electrode which is secured in vacuum-tight relation thereto.

Rod-shaped impulse discharge lamps of conventional construction comprise a glass or quartz tube having a respective rod-shaped electrode at each end of the structure with the electrodes extending into the discharge chamber with the latter being suitably melted to effect an axial fusing of the associated rod therewith. Both electrodes extend into the discharge chamber with the internal end portion of the electrode, not coated with glass, operative to feed the plasma with the energy needed for the generation of the light flash. For technical reasons involved in the production, the glass beading or bulge of the securement has a length of several millimeters at the sealing. In addition, the internal electrode ends, which are not coated with glass, also must extend several millimeters into the internal chamber of the impulse discharge lamp, so that the inner electrode end can effectively carry a central body containing suitable activation material, and at the same time the electrode end will not be locally overheated by excessively high current densities, and be brought to vaporization.

In a newer construction of impulse discharge lamps, two metal discs, produced from a material which is suitable for fusing, are fused onto the respective end faces of a glass tube, with the diameter of such discs being larger than the internal diameter of the tube at the point of fusing. In this construction the electrical energy is fed to the plasma across the internal surface areas of the discs. Likewise, the external length of an impulse discharge lamp constructed in this manner is greater than the effective internal length, i.e. the distance between the two active inner surfaces of the electrodes, by merely twice the thickness of the metal discs. In the production of impulse discharge lamps of this later construction, the glass tube is cut size, and it, with the two electrodes, are disposed in predetermined positions relative to one another within a suitable receptacle. Following evacuation, the receptacle is filled with inert gas, preferably Xenon. The respective electrodes are then heated inductively and pressed against the glass ends of the tube to thereby fuse the electrodes thereto in vacuum-tight relation. The inert gas subsequently is pumped out of the receptacle and the assembled impulse discharge lamp removed therefrom.

In the production of the initially mentioned impulse discharge lamps, of conventional construction, the glass-tube itself may be considered to function as its own receptacle, and is initially sealed at one end in vacuum-tight relation, following which the electrodes are disposed loosely into the rough glass tube and the open end thereof connected to a pump to evacuate the tube, which is thereafter filled with inert gas. The free end of the tube may then be sealed by a temporary closure thereof to permit separation from the pump, following which the movable electrodes are brought into the desired positions within the tube and the latter melted at the desired points to effect a fusing thereof while the tube is in a vacuum-tight condition. The excessive protruding glass portions at each end are subsequently cut off.

It will be appreciated that this type of production procedure has substantial advantages in connection with the production of the first described type of impulse discharge lamp. First, the mechanical expense for the same production quantity can be kept substantially lower. Further, the gas with which the tube is to be filled is not contaminated by foreign gases absorbed during each pumping operation, resulting from the desorption on the inner walls of the receptacle, the mounting structure or jig for the tube and electrodes, on high frequency coils, and/or other parts. In addition, the conventional type of procedure produces impulse discharge lamps in which the fused metal-glass joint between tube and electrode is not stressed for tension forces but rather for shear forces resulting from the high internal pressures which occur during discharge. As a result, the operating safety of impulse discharge lamps produced in this manner is increased, as glass-metal unions have only a relatively low strength with respect to tension stresses.

BRIEF SUMMARY OF THE INVENTION

The present invention has, as a primary objective, the creation of a rod-shaped impulse discharge lamp which, for equal discharge length, may have a considerably shorter external length than the conventional impulse discharge lamps initially described, and in which the entire inner chamber is filled by the luminous plasma during discharge. This objective is achieved, in accordance with the present invention, by a construction in which the electrodes of the rod-shaped impulse discharge lamp are of disc-shaped configuration, either of solid construction or of cup-shaped construction, and have an external diameter slightly less than the internal diameter of the discharge receptacle, with the electrodes being secured at their peripheral edges with the internal surfaces of the discharge receptacle at the outer ends thereof. The discharge receptacle of the impulse discharge lamp preferably is formed of quartz or glass with the two electrodes being fused into the outer ends of the discharge receptacle, the thickness of the electrodes expediently being less than their diameter and, preferably, at least one electrode is provided with an activation layer.

the invention proceeds from the fact that the degree of light output of the discharge lamp increases with an increasing number of ionized gas atoms per unit of volume. The degreee of light output therefore can be improved by, among other things, an increase in the filling pressure within the discharge receptacle. However, this expedient is effective only up to limited values since the ignition threshold of the impulse discharge lamp is reduced significantly at higher pressures. During the discharge operation, the temperature of the gas, and thus the pressure within the discharge zone rises considerably. As a consequence, a flowing off or draining takes place of gas atoms or ions from high pressure regions within the receptacle to portions thereof in which no discharge takes place and at which a relatively low pressure therefore exists. This action thus corresponds to a considerable reduction of the effective gas atom density required for a high light output.

The maximum light output in a lamp of predetermined filling pressure, is therefore achieved by a lamp construction in which the entire discharge receptacle is completely filled with plasma. The impulse discharge lamp in accordance with the invention, thus has a substantially absolute minimum external length and thus minimum space requirements therefor, while at the same time having a high light output consistent with its small size. Further, in addition to such advantages, the lamp has the advantage that it can be produced by a method having the advantages of the conventional production techniques initially described.

BRIEF DESCRIPTION OF THE DRAWING

The FIGURE of the drawing illustrates, in longitudinal section, an impulse discharge lamp constructed in accordance with the invention.

DETAILED DESCRIPTION OF THE INVENTION

Referring to the drawing, in which the impulse discharge lamp is schematically illustrated, a tube 3, for example of glass, forms a discharge receptacle having, at its respective ends, electrodes 1 and 2, which are secured thereto in vacuum-tight relation. As illustrated, the electrode 1 may, for example, be provided with an activation layer 4. The electrodes 1 and 2 are of disc-shaped configuration and have an external diameter which is only slightly less than the internal diameter of the discharge receptacle, the tube 3, with the thickness of the respective electrode being less than its diameter. The external diameter of the electrode may, for example, be 4.0 mm and the inside diameter of the discharge receptacle 4.3 mm, with the electrodes having a thickness of 1.5 mm.

As illustrated in the drawings, the electrodes are inserted into the tube 3, with the external edges of the electrodes secured in vacuum-type relation to the adjacent internal surface of the tube, at the outer ends thereof. Thus, pressure within the receptacle is translated into shear stresses between the external peripheral edge of the associated electrode and internal peripheral surface of the tube, to provide a relatively very strong connection therebetween. It will also be noted that with the exception of the necessary thickness of the electrodes and any activation layer carried thereby, the full length of the tube is available for illumination. Likewise, as a result the respective electrodes extending substantially entirely over the cross-sectional area of the tube interior, the entire volume of the tube interior will be filled with plasma to produce a high light output.

In a preferred method of production, the electrodes 1 and 2, which, if deemed desirable, may be provided with a suitable retaining or supporting in, are inserted into a tube, for example of glass, which is to form the discharge receptacle and the latter evacuated in conventional, known manner and filled with inert gas. With the electrodes in the desired positions, the tube is subsequently heated to the softening point at the areas opposite the external peripheral edge surfaces of the electrodes 1 and 2, whereby the material in the tube will come into contact and fuse with the electrodes along the entire outer edge surface thereof to form a vacuum-tight connection. Upon completion of the attachment of both electrodes to the tube, the protruding tube ends may be cut off substantially flush with the outer faces of the associated electrodes. As the tube initially surrounds the respective electrodes at all circumferential points, the tube can, if sealed off at one end and connected to the pump at the other end, it can then take over the function of the separate container required in connection with the more recent production method heretofore described.

The heating of the electrodes 1 and 2, and of the material of the discharge receptacle adjacent the electrodes 1 and 2, can be effected by any suitable means, as for example inductive heating of the electrodes, or by heat applied to the external surfaces of the glass tube, by suitable means such as gas flames, plasma burners, heater coils or the like.

The fusing of one or both electrodes can take place either while the tube is still connected to the pump, or it can be provided with a temporary closure and thereafter separated from the pump, with the fusing of the tube and electrodes taking place in a subsequent operation on operations.

It will be appreciated that the invention is not limited to the specific sample embodiment illustrated, as the operative surfaces of both electrodes can, for example, as deemed necessary or desirable, be coated with an activation layer. Further, the respective electrodes can be provided at their external face with a contact pin, a contact disc, or other suitable terminal structure. Likewise, as previously mentioned, the electrodes can be formed as a solid cylindrical discs, as illustrated, or can be drawn from thin sheet metal to produce a cup-shaped configuration, i.e. with an annular tubular flange at its peripheral edge which, in turn, is fused to the internal surface of the glass tube.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. An impulse discharge lamp comprising a hollow gas-filled cylindrical discharge receptacle of glass or quartz, preferably containing an inert gas, with each end of the receptacle provided with an electrode, directly secured in vacuum-tight relationship thereto, said electrodes having a disc-like configuration and an external diameter, which defines the effective areas of the respective electrodes, and which external diameter is slightly less than the internal diameter of the discharge receptacle, said electrodes being disposed within the receptacle at the outer ends thereof with the outer faces of the electrodes substantially flush with the respective adjacent end edges of the discharge receptacle whereby such effective electrode areas correspond substantially to the inner diameter of the receptacle, and the receptacle chamber, during operation, is filled from end to end with luminous plasma the internal surface of the receptacle at each end thereof being fused in vacuum-tight relation to the external edge surface of the associated electrode.

2. An impulse discharge lamp according to claim 1, wherein at least one electrode is provided with an activation layer on its inner face.

3. An impulse discharge lamp according to claim 1, wherein the thickness of the respective electrodes is less than their diameter.

4. An impulse discharge lamp according to claim 3, wherein at least one electrode is provided with an activation layer on its inner face.

* * * * *